US006305248B1

(12) United States Patent
Rowlay

(10) Patent No.: US 6,305,248 B1
(45) Date of Patent: Oct. 23, 2001

(54) RATCHETING DRIVER

(75) Inventor: Stephen Rowlay, Sheffield (GB)

(73) Assignee: The Stanley Works Limited, Sheffield (GB)

( * ) Notice: Subject to any disclaimer, the term of this patent is extended or adjusted under 35 U.S.C. 154(b) by 0 days.

(21) Appl. No.: 09/357,075

(22) Filed: Jul. 19, 1999

(30) Foreign Application Priority Data

Aug. 3, 1998 (GB) ..... 9816878

(51) Int. Cl.[7] ..... B25B 13/46
(52) U.S. Cl. ..... 81/62; 81/63; 81/63.1; 81/63.2
(58) Field of Search ..... 81/60–63.2

(56) References Cited

U.S. PATENT DOCUMENTS

| | | | | |
|---|---|---|---|---|
| 3,356,117 | * | 12/1967 | Wagner . | |
| 3,575,069 | | 4/1971 | White . | |
| 4,259,883 | * | 4/1981 | Carlson . | |
| 4,290,328 | | 9/1981 | Clark | 81/62 |
| 5,094,490 | * | 3/1992 | Shirey . | |
| 5,437,212 | | 8/1995 | Thompson et al. . | |
| 5,501,124 | | 3/1996 | Ashby . | |
| 5,613,585 | | 3/1997 | Tiede . | |
| 5,685,204 | | 11/1997 | Braun . | |
| 5,749,272 | | 5/1998 | Phan | 81/62 |
| 5,816,119 | * | 10/1998 | Herue . | |
| 5,967,003 | * | 10/1999 | Lin . | |

FOREIGN PATENT DOCUMENTS

| | | |
|---|---|---|
| 29800921 U1 | 3/1998 | (DE) . |
| 0 358 884 A1 | 3/1990 | (EP) . |
| 661 139 A1 | 7/1995 | (EP) . |
| 2 274 402 | 10/1977 | (FR) . |
| 584232 | 1/1947 | (GB) . |
| 2 146 279 A | 4/1985 | (GB) . |

* cited by examiner

*Primary Examiner*—Timothy V. Eley
*Assistant Examiner*—Willie Berry, Jr.
(74) *Attorney, Agent, or Firm*—Pillsbury Winthrop LLP

(57) ABSTRACT

A ratcheting driver has a shaft rotatable relative to a handle, and a ratchet mechanism between the handle and the shaft. The ratchet mechanism has a body fixed to the handle. A spur gear coaxial with the shaft is mounted in the body so as to be rotatable about a common rotation axis of the shaft and the spur gear. First and second pawls are mounted on the body so as to be tiltable about axes parallel to the rotation axis and on opposite sides of an imaginary plane containing the rotation axis. Each pawl has a free end between its tilting axis and the said plane, and is tiltable between an engaging position, in which its free end intersects the tip cylinder of the spur gear and can abut against the flank of a gear tooth to prevent rotation of the gear in one direction relative to the body, and a non-engaging position, in which its free end lies outside the tip cylinder. A control member having first and second spring legs is movable to a first ratcheting position, in which the first leg urges the first pawl to the engaging position and the second leg urges the second pawl to the non-engaging position, a second ratcheting position, in which the first leg urges the first pawl to the non-engaging position and the second leg urges the second pawl to the engaging position, and an intermediate non-ratcheting position, in which both legs urge both pawls to the engaging position. A control sleeve rotatably mounted on the body, being captive between the handle and the body, is linked to the control member so that rotation of the control sleeve clockwise and anticlockwise from a given position moves the control member from the intermediate non-ratcheting position to the first and second ratcheting positions respectively.

5 Claims, 2 Drawing Sheets

RATCHETING DRIVER

FIELD OF INVENTION

This invention relates to a ratchet mechanism for a ratcheting driver, in particular a screwdriver.

DESCRIPTION OF PRIOR ART

Conventional ratchet mechanisms for screwdrivers have pawls which extend in the axial direction of the shaft of the screwdriver and which have narrow extensions engageable with the teeth of a gear provided on the shaft. The pawls are pushed into and out of engagement with the gear by a control member which is usually slidable in the axial direction. Such ratchet mechanisms occupy a significant proportion of the overall length of the screwdriver. Other ratchet mechanisms have been proposed which may require less length but which are complex and difficult to assemble.

It would be desirable to be able to provide a ratchet mechanism which is of short axial length, requires only a minimum number of parts, and is easy to assemble.

SUMMARY OF THE INVENTION

The present invention provides a ratcheting driver comprising a handle, a shaft rotatable relative to the handle, and a ratchet mechanism interposed between the handle, and the shaft. The ratchet mechanism comprises a body fixed to the handle; and a spur gear coaxially fixed with respect to the shaft and mounted in the body so as to be rotatable together with the shaft relative to the body about a common rotation axis of the shaft and the spur gear. First and second pawls are mounted on the body so as to be tiltable about respective tilting axes parallel to the rotation axis and on opposite sides of an imaginary plane containing the rotation axis, each pawl having a free end between its tilting axis and the said plane. Each pawl is tiltable between an engaging position, in which its free end intersects the tip cylinder of the spur gear and can abut against the flank of a gear tooth to prevent rotation of the gear in one direction relative to the body, and a non-engaging position, in which its free end lies outside the tip cylinder.

A control member having first and second spring legs is movable to a first ratcheting position, in which the first leg urges the first pawl to the engaging position and the second leg urges the second pawl to the non-engaging position, a second ratcheting position, in which the first leg urges the first pawl to the non-engaging position and the second leg urges the second pawl to the engaging position, and an intermediate non-ratcheting position, in which both legs urge both pawls to the engaging position.

A control sleeve is rotatably mounted on the body and is linked to the control member so that rotation of the control sleeve clockwise and anticlockwise from a given position moves the control member from the intermediate non-ratcheting position to the first and second ratcheting positions respectively.

DETAILED DESCRIPTION OF PREFERRED EMBODIMENTS

Figure 1:
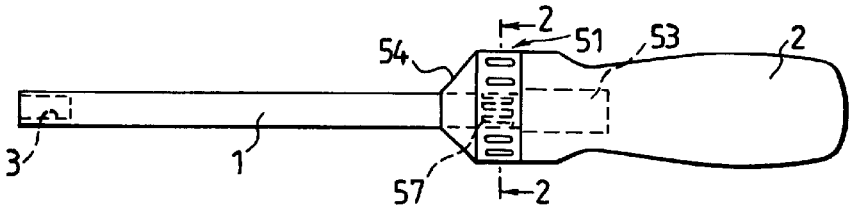
FIG. 1 is a side view of a screwdriver incorporating a ratchet mechanism.
Figure 2:
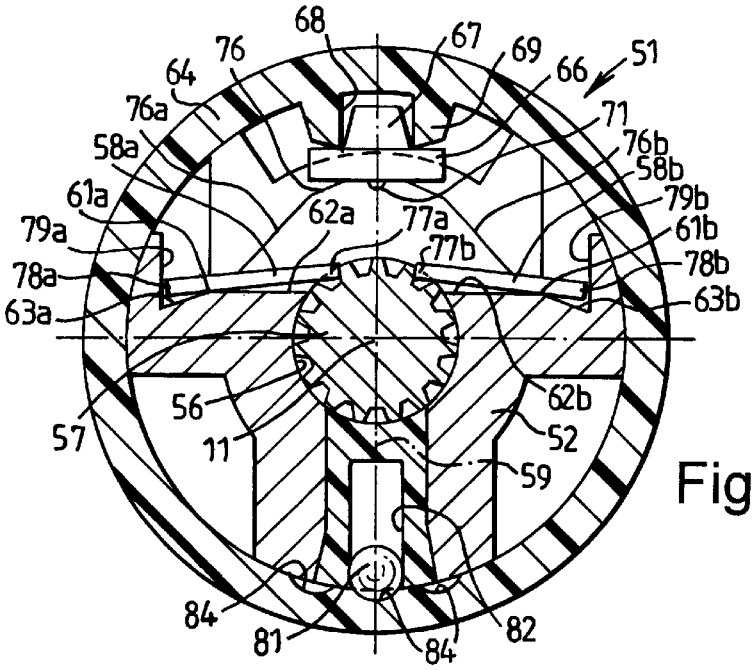
FIG. 2 is a section on line 2—2 in FIG. 1, the ratchet mechanism being in a locked state, in which a screw can be driven in both directions.
Figure 3:
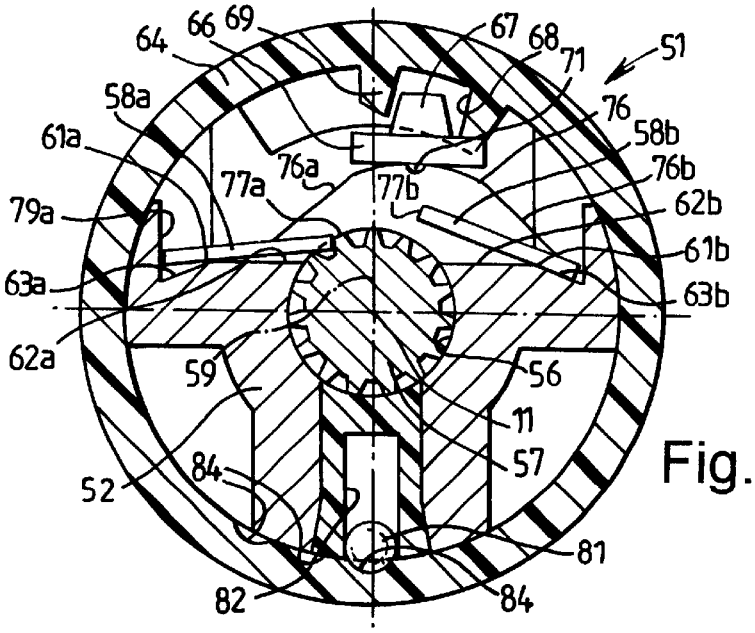
FIG. 3 is a view similar to FIG. 2, the ratchet mechanism being in a first ratcheting mode, in which a screw can be driven only in the clockwise direction.

The ratcheting driver shown in FIGS. 1 to 3 has a steel bar or shaft 1 which extends from one end of a composite plastics handle 2 having a hard polypropylene core. The distal end of the shaft has a hexagonal recess 3 for receiving the hexagonal stub of a conventional tool-bit. A permanent magnet is fixed in the base of the hexagonal recess 3 in order to retain the bit in use.

The front end of the handle 2 is provided with a reversible ratchet mechanism 51 with a die cast body 52 having a hexagonal rear extension 53 which is press fitted into the core of the handle 2. The front of the ratchet mechanism is closed by a removable cover 54.

The shaft 1 is mounted in a bore 56 in the body 52 so as to be rotatable about the longitudinal axis 11 of the shaft. A spur gear 57 is machined in the shaft, the tip cylinder of the gear substantially coinciding with the circular profile of the cylindrical shaft 1. Beyond the gear 57 the shaft has an extension of smaller diameter (not shown in FIGS. 1 to 3) rotatably mounted in a blind bore in the rear extension 53 of the body 52.

First and second elongate rockable pawls 58*a* and 58*b* are mounted symmetrically on the body 52 on opposite sides of an imaginary plane 59 containing the rotation axis 11. Each pawl 58*a* (58*b*) is a substantially flat elongate element (a rectangular plate) tiltable about an axis defined by a fulcrum 61*a* (61*b*) which extends parallel to the rotation axes 11 and which is defined between two adjacent flat faces 62*a* and 63*a* (62*b* and 63*b*) formed on the body 52.

A control sleeve 64 is rotatably mounted on the body 52 before the body is fixed to the handle 2. The control sleeve 64 has a flange 65 (FIG. 5) which is slidably trapped between the body 52 and the handle 2 so that the control sleeve is captive and cannot be removed without removing the body 52 from the handle. A control member 66 in the form of a plate has an outward projection 67 loosely fitted in a recess 68 provided in an inwardly projecting part 69 of the control sleeve 64. Connected to the control member 66 by a rivet 71 is a leaf spring 76 having two symmetrical spring legs 76*a* and 76*b* which act on the respective pawls 58*a* and 58*b* and keep them in contact with the respective fulcrums 61*a* and 61*b*.

In FIG. 2 the ratchet mechanism 51 is shown in an intermediate non-ratcheting state, in which the first and second spring legs 76*a* and 76*b* urge the first and second pawls 58*a* and 58*b* to engaging positions in which the free inner end 77*a* (77*b*) of each pawl 58*a* (58*b*) intersects the tip cylinder of the spur gear 57 and can abut against the flank of a gear tooth to prevent rotation of the gear in each direction relative to the body 52. The outer rear end 78*a* (78*b*) of each pawl 58*a* (58*b*) abuts against a face 79*a* (79*b*) formed on the body 52, to provide a reaction to the force of the gear tooth abutting against the pawl.

In FIG. 3, the control sleeve 64 has been turned from the intermediate non-ratcheting position (FIG. 2) in a clockwise direction, as viewed from the handle 2, to a first ratcheting position, in which the first spring leg 76*a* urges the first pawl

58*a* to the engaging position and the second spring leg acts on the part of the second pawl 58*b* outside the fulcrum 61*b* so as to urge the second pawl 58*b* to a non-engaging position (as shown in FIG. 3) in which its free end 77*b* lies outside the tip cylinder of the gear 57 and the pawl rests on the sloping face 63*b* of the body 52. In this state of the ratchet mechanism 51 rotation of the handle 2 in the clockwise direction turns the shaft 1 in the same direction, whereas rotation of the handle in the anti-clockwise direction does not rotate the shaft, since the lower surface of the first pawl 58*a* rides over the teeth of the gear 57.

Clearly, when the control sleeve 64 is turned in the anti-clockwise direction from the intermediate position of FIG. 2 to a second ratcheting position which is the mirror image of the first ratcheting position shown in FIG. 3, then rotation will be transmitted from the handle to the shaft only in the anti-clockwise direction.

The control sleeve 64 is located in each of its three positions by a spring loaded ball 81 which is mounted in a radial blind bore 82 in an insert 83 in the body 52 and which selectively engages in three part-spherical notches 84 inside the control sleeve 64.

Various modifications may be made within the scope of the invention. For example, the cover 54 may be removed and replaced by a tool-bit magazine.

Figure 4:
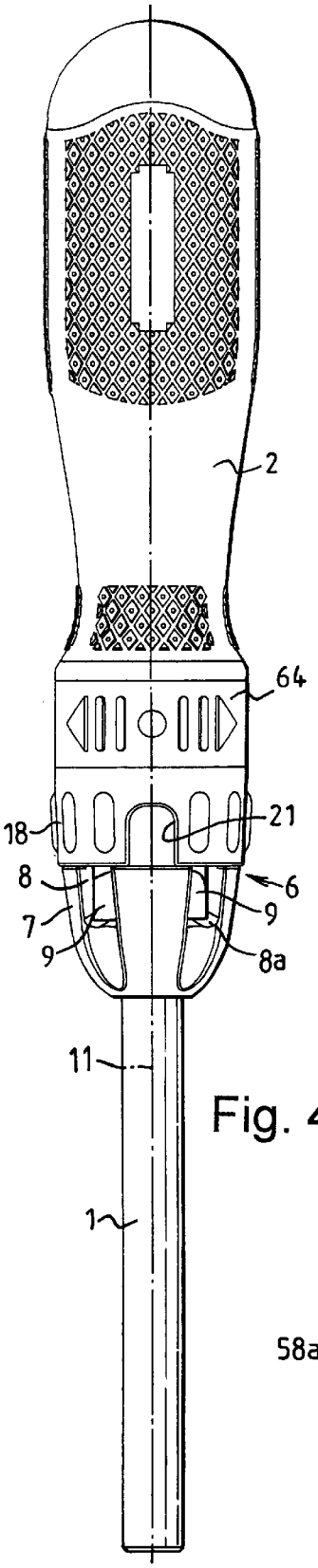
FIG. 4 is a side view of a preferred embodiment of the screwdriver.
Figure 5:
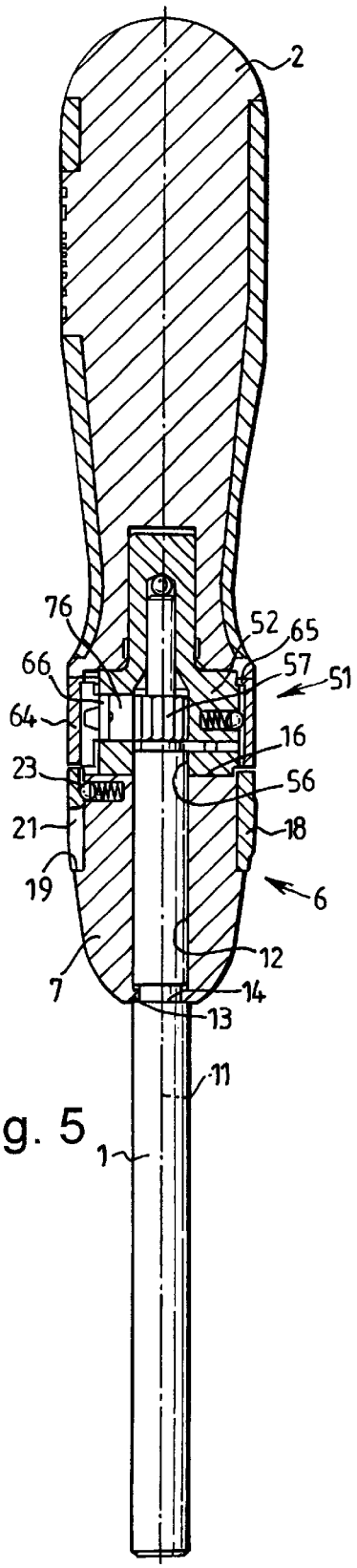
FIG. 5 is an axial section through the screwdriver of FIG. 4.
Figure 6:
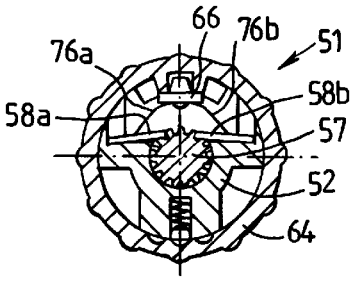
FIG. 6 is a cross-section through the ratchet mechanism of the screwdriver of FIG. 4.

FIGS. 4 to 6 show a preferred embodiment of the screwdriver, in which parts similar to those described above are given the same reference numerals. The screwdriver has a tool-bit magazine 6 with a body 7 having recesses 8 accommodating tool bits 9. The body 7 has an axial bore which is a sliding fit on the shaft 1. A portion 13 of the body 7 engages in a circumferential groove 14 machined in the shaft 1. A sleeve 18 is mounted in a circumferential recess 19 in the body 7 so as to be rotatable to respective positions in which a slot 21 is in register with a respective recess 8, to permit insertion or removal of a bit 9. A spring loaded ball 23 mounted on the body 7 engages in a circumferential series of notches in the sleeve 18.

The screwdriver shown in FIGS. 4 to 6 also has a ratchet mechanism 51 between the magazine 6 and the handle 2. The ratchet mechanism has a body 62 with a bore 56 receiving the shaft 1 which is formed with a spur gear 57 engageable by pawls 58*a* and 58*b* which are tiltable about axes parallel to the shaft axis 11. A control sleeve 64 is linked to a control member 66 carrying a leaf spring 76 with legs 76*a* and 76*b* which bear on the pawls 58*a* and 58*b* respectively. The control sleeve 64 has a peripheral flange 65 captive between the body 52 and the handle 2. The control sleeve 64 is movable clockwise and anticlockwise from the intermediate position shown in FIG. 6, in which both pawls 58*a* and 58*b* and engaged with the gear 57, to respective ratcheting positions in which only one or the other of the pawls is engaged with the gear 57.

The rear end surface 16 of the magazine body 7 abuts against the front surface of the body 62, against which the rear ends of the bits 9 rest. The tips of the bits 9 rest against sloping front end surfaces 8*a* of the recesses 8.

The magazine 6 is described in more detail in U.K. Patent Application No. 9816876.8 entitled "Tool-bit magazine", filed Aug. 3, 1998, and my U.S. Pat. No. Application entitled "Tool-bit Magazine for Hand Tool", filed contemporaneously herewith, the contents of which are hereby incorporated by reference.

I claim:

1. A ratcheting driver comprising a handle, a shaft rotatable relative to the handle, and a ratchet mechanism interposed between the handle and the shaft, the ratchet mechanism comprising:

a body fixed to the handle;

a spur gear coaxially fixed with respect to the shaft and mounted in the body so as to be rotatable together with the shaft relative to the body about a common rotation axis of the shaft and the spur gear;

first and second pawls mounted on the body so as to be tiltable about respective tilting axes parallel to the rotation axis and on opposite sides of an imaginary plane containing the rotation axis, each of the first and second pawls having a free end between its tilting axis and said plane, each of the first and second pawls being tiltable between an engaging position, in which a free end intersects an imaginary tip cylinder of the spur gear and can abut against a flank of a gear tooth to prevent rotation of the spur gear in one direction relative to the body, and a non-engaging position, in which the free end lies outside said tip cylinder;

a control member having first and second spring legs, the control member being movable to a first ratcheting position, in which the first leg urges the first pawl to the engaging position and the second leg urges the second pawl to the non-engaging position, a second ratcheting position, in which the first leg urges the first pawl to the non-engaging position and the second leg urges the second pawl to the engaging position, and an intermediate non-ratcheting position, in which both legs urge both pawls to the engaging position; and a control sleeve rotatably mounted on the body, the control member being located in an interior portion of the control sleeve and being linked to the control sleeve so that rotation of the control sleeve clockwise and anticlockwise from a given position moves the control member from the intermediate non-ratcheting position to the first and second ratcheting positions respectively, wherein each of the first and second pawls is a substantially flat elongate element tiltable on a fulcrum on the body, the fulcrum defining the tilting axis of the pawl, the respective spring legs keeping the respective pawls in contact with the respective fulcrums, each of the first and second pawls having a rear end which is on an opposite side of the fulcrum with respect to the free end and which abuts against the body to provide a reaction to the force of a gear tooth abutting against the pawl when the pawl is in the engaging position.

2. A ratcheting driver comprising a handle, a shaft rotatable relative to the handle, and a ratchet mechanism interposed between the handle and the shaft, the ratchet mechanism comprising:

a body fixed to the handle;

a spur gear coaxially fixed with respect to the shaft and mounted in the body so as to be rotatable together with the shaft relative to the body about a common rotation axis of the shaft and the spur gear;

first and second pawls mounted on the body so as to be tiltable about respective tilting axes parallel to the rotation axis and on opposite sides of an imaginary plane containing the rotation axis, each of the first and second pawls having a free end between its tilting axis and said plane, each of the first and second pawls being tiltable between an engaging position, in which a free end intersects an imaginary tip cylinder of the spur gear and can abut against a flank of a gear tooth to prevent rotation of the spur gear in one direction relative to the body, and a non-engaging position, in which the free end lies outside said tip cylinder;

a control member having first and second spring legs, the control member being movable to a first ratcheting position, in which the first leg urges the first pawl to the engaging position and the second leg urges the second pawl to the non-engaging position, a second ratcheting position, in which the first leg urges the first pawl to the non-engaging position and the second leg urges the second pawl to the engaging position, and an intermediate non-ratcheting position, in which both legs urge both pawls to the engaging position; and a control sleeve rotatably mounted on the body, the control member being located in an interior portion of the control sleeve and being linked to the control sleeve so that rotation of the control sleeve clockwise and anticlockwise from a given position moves the control member from the intermediate non-ratcheting position to the first and second ratcheting positions respectively, wherein the control member has an outward projection loosely fitted in a recess inside the control sleeve.

3. A ratcheting driver comprising a handle, a shaft rotatable relative to the handle, and a ratchet mechanism interposed between the handle and the shaft, the ratchet mechanism comprising:

a body fixed to the handle;

a spur gear coaxially fixed with respect to the shaft and mounted in the body so as to be rotatable together with the shaft relative to the body about a common rotation axis of the shaft and the spur gear;

first and second pawls mounted on the body so as to be tiltable about respective tilting axes parallel to the rotation axis and on opposite sides of an imaginary plane containing the rotation axis, each of the first and second pawls having a free end between its tilting axis and said plane, each of the first and second pawls being tiltable between an engaging position, in which a free end intersects an imaginary tip cylinder of the spur gear and can abut against a flank of a gear tooth to prevent rotation of the spur gear in one direction relative to the body, and a non-engaging position, in which the free end lies outside said tip cylinder;

a control member having first and second spring legs, the control member being movable to a first ratcheting position, in which the first leg urges the first pawl to the engaging position and the second leg urges the second pawl to the non-engaging position, a second ratcheting position, in which the first leg urges the first pawl to the non-engaging position and the second leg urges the second pawl to the engaging position, and an intermediate non-ratcheting position, in which both legs urge both pawls to the engaging position; and a control sleeve rotatably mounted on the body, the control member being located in an interior portion of the control sleeve and being linked to the control sleeve so that rotation of the control sleeve clockwise and anticlockwise from a given position moves the control member from the intermediate non-ratcheting position to the first and second ratcheting positions respectively, wherein the control sleeve is captive between the handle and the body, the control sleeve having a radially inwardly directed flange located in a gap between mutually opposed abutment surfaces on the handle and the body respectively.

4. A ratcheting driver comprising a handle, a shaft rotatable relative to the handle, and a ratchet mechanism interposed between the handle and the shaft, the ratchet mechanism comprising:

a body fixed to the handle;

a spur gear coaxially fixed with respect to the shaft and mounted in the body so as to be rotatable together with the shaft relative to the body about a common rotation axis of the shaft and the spur gear;

first and second pawls mounted on the body so as to be tiltable about respective tilting axes parallel to the rotation axis and on opposite sides of an imaginary plane containing the rotation axis, each of the first and second pawls having a free end between its tilting axis and said plane, each of the first and second pawls being tiltable between an engaging position, in which a free end intersects an imaginary tip cylinder of the spur gear and can abut against a flank of a gear tooth to prevent rotation of the spur gear in one direction relative to the body, and a non-engaging position, in which the free end lies outside said tip cylinder, wherein each of the first and second pawls is a substantially flat elongate element tiltable on a fulcrum on the body, the fulcrum defining the tilting axis of the pawl, the respective spring legs keeping the respective pawls in contact with the respective fulcrums, each of the first and second pawls has a rear end which is on an opposite side of the fulcrum with respect to the free end and which abuts against the body to provide a reaction to the force of a gear tooth abutting against the pawl when the pawl is in the engaging position;

a control member having first and second spring legs, the control member being movable to a first ratcheting position, in which the first leg urges the first pawl to the engaging position and the second leg urges the second pawl to the non-engaging position, a second ratcheting position, in which the first leg urges the first pawl to the non-engaging position and the second leg urges the second pawl to the engaging position, and an intermediate non-ratcheting position, in which both legs urge both pawls to the engaging position; and a control sleeve rotatably mounted on the body, the control member being linked to the control sleeve so that rotation of the control sleeve clockwise and anticlockwise from a given position moves the control member from the intermediate non-ratcheting position to the first and second ratcheting positions respectively.

5. A ratcheting driver comprising a handle, a shaft rotatable relative to the handle, and a ratchet mechanism interposed between the handle and the shaft, the ratchet mechanism comprising:

a body fixed to the handle;

a spur gear coaxially fixed with respect to the shaft and mounted in the body so as to be rotatable together with the shaft relative to the body about a common rotation axis of the shaft and the spur gear;

first and second pawls mounted on the body so as to be tiltable about respective tilting axes parallel to the rotation axis and on opposite sides of an imaginary plane containing the rotation axis, each of the first and second pawls having a free end between its tilting axis and said plane, each of the first and second pawls being tiltable between an engaging position, in which a free end intersects an imaginary tip cylinder of the spur gear and can abut against a flank of a gear tooth to prevent rotation of the spur gear in one direction relative to the body, and a non-engaging position, in which the free end lies outside said tip cylinder;

a control member having first and second spring legs, the control member being movable to a first ratcheting position, in which the first leg urges the first pawl to the engaging position and the second leg urges the second pawl to the non-engaging position, a second ratcheting position, in which the first leg urges the first pawl to the non-engaging position and the second leg urges the second pawl to the engaging position, and an intermediate non-ratcheting position, in which both legs urge both pawls to the engaging position; and a control sleeve rotatably mounted on the body, the control member having an outward projection loosely fitted in a recess inside the control sleeve and thereby being linked to the control sleeve so that rotation of the control sleeve clockwise and anticlockwise from a given position moves the control member from the intermediate non-ratcheting position to the first and second ratcheting positions respectively.

* * * * *